US006152632A

United States Patent [19]

Shimakage et al.

[11] Patent Number: 6,152,632

[45] Date of Patent: Nov. 28, 2000

[54] DISPENSER FOR ROD-LIKE GLUE

[75] Inventors: Humio Shimakage, Kawasaki; Yoshio Sumita, Koshigaya, both of Japan

[73] Assignee: Tombow Pencil Co., LTD, Tokyo, Japan

[21] Appl. No.: 09/351,906

[22] Filed: Jul. 14, 1999

[30] Foreign Application Priority Data

Dec. 28, 1998 [JP] Japan ..... 10-376927

[51] Int. Cl.[7] ..... B43M 11/08; B43K 21/08

[52] U.S. Cl. ..... 401/72; 222/390; 401/75; 401/86; 401/87; 401/175

[58] Field of Search ..... 401/68, 72, 75, 401/76, 82, 86, 87, 116, 174, 175; 222/390

[56] References Cited

U.S. PATENT DOCUMENTS

| | | | |
|---|---|---|---|
| 2,818,167 | 12/1957 | McKinley | 401/87 X |
| 3,612,704 | 10/1971 | Marchant | 401/72 X |
| 3,917,417 | 11/1975 | Lang | 401/72 |
| 5,505,041 | 4/1996 | Harlan | 401/175 X |

FOREIGN PATENT DOCUMENTS

| | | |
|---|---|---|
| 51-21909 | 5/1973 | Japan . |
| 53-3895 | 11/1973 | Japan . |
| 53-3896 | 11/1973 | Japan . |
| 53-15640 | 10/1974 | Japan . |

*Primary Examiner*—Henry J. Recla
*Assistant Examiner*—Kathleen J. Prunner
*Attorney, Agent, or Firm*—Birch, Stewart, Kolasch & Birch, LLP

[57] ABSTRACT

To make full use of a rod-like glue contained in a cylindrical dispenser main body of a glue dispenser to its final portion, a spiral member of a rotary operator element of the glue dispenser has a spiral outer diameter which is set to be equal to or larger than 30% and equal to or smaller than 80% of the outer diameter of rod-like glue, and a spiral pitch which is set to be equal to or larger than 50% and equal to or smaller than 300% of the spiral outer diameter. The spiral member is directly screwed to the rod-like glue integrally attached to a slider coupled with a bottom portion of the glue by elastic retaining pieces by which it is not necessary to form a top face of the slider in a recessed shape. The rod-like glue can be extracted and retracted from and to a dispenser main body by moving up and down the glue by rotating the rotary operator element. The elastic retaining pieces fold down by strongly pressing the rod-like glue onto a coating face when the rod-like glue is decreased to a length close to the elastic retaining pieces. The rod-like glue therefore can be fully used up to its lowermost portion.

3 Claims, 1 Drawing Sheet

DISPENSER FOR ROD-LIKE GLUE

BACKGROUND OF THE INVENTION

1. Field of the Invention

The present invention relates to a dispenser for rod-like glue capable of extracting and retracting rod-like glue contained in a dispenser main body in using it.

2. Description of the Related Art

Conventionally, in a dispenser for rod-like glue capable of extracting and retracting rod-like glue contained in a cylindrical dispenser main body, the rod-like glue is held by being molded integrally with a slider having a recessed shape and screwed to a spiral member projecting into the dispenser main body and attached to a rotary operator element connected integrally with a bottom portion of the dispenser main body. By moving up and down the slider screwed integrally with the spiral member of the rotary operator element by rotating the rotary operator element attached integrally with the bottom portion of the dispenser main body, the rod-like glue is extracted and retracted from and to a front end opening portion of the cylindrical dispenser main body.

However, in the conventional glue dispenser, the rod-like glue which can be extracted and retracted from and to the front end opening portion of the dispenser main body in a cylindrical shape, the slider screwed to the spiral member projecting into the dispenser main body of the rotary operator element integrally attached to the bottom portion of the dispenser main body for moving up and down the rod-like glue by rotating the rotary operator element, has a recessed shape to become integral with the glue in molding the rod-like glue. This slider can integrally hold a bottom portion of the rod-like glue by solidifying and molding the glue melted in the cylindrical dispenser main body. When the length of the rod-like glue is decreased during use of it, a portion of the glue incorporated at the inside of the slider having the recessed shape cannot be used and becomes useless since an end edge of the slider comes into contact with a coating face.

Further, when the rod-like glue is extracted and retracted from and to the front end opening portion of the dispenser main body in a cylindrical shape by moving up and down the slider screwed to the spiral member of the rotary operator element attached integrally with the bottom portion of the dispenser main body, the structure becomes complicated, the number of parts is increased and the assembly steps also become complicated which conributes to an increase of the assembly cost.

SUMMARY OF THE INVENTION

Hence, it is an object of the present invention to overcome the disadvantages of conventional dispensers. In particular it is an object of the invention to provide a dispenser of the above-mentioned type which permits a full use of the rod-like glue contained in a dispenser main body to its final portion. Still a further object is to provide a dispenser of the above-mentioned type having a less complicated structure.

The above-mentioned objects are achieved in accordance with the present invention by a dispenser for rod-like glue, including a cylindrical dispenser main body holding a rod-like glue a bottom portion of which is bonded with a slider, for extracting and retracting the glue from and to a front end opening portion, and a rotary operator element having a spiral member projecting into the dispenser main body and rotatably attached to a bottom portion of the dispenser main body for extracting and retracting the rod-like glue, wherein the spiral member of the rotary operator element has a spiral outer diameter which is set to be equal to or larger than 30% and equal to or smaller than 80% of an outer diameter of the rod-like glue, and a spiral pitch which is set to be equal to or larger than 50% and equal to or smaller than 300% of the spiral outer diameter, said spiral member of the rotary operator element is screwed directly to the rod-like glue provided in the cylindrical dispenser main body. A lid for maintaining airtightness can be mounted to a front end portion of the dispenser main body.

In the glue dispenser according to the invention, in respect of the spiral member of the rotary operator element directly screwed to the rod-like glue and extending through the slider, when the spiral outer diameter of the spiral member would be less than 30% of the outer diameter of the rod-like glue, an area of contact between the spiral member and the rod-like glue would become insufficient resulting in an idling rotation of the spiral member. Further, when the spiral outer diameter would be larger than 80%, the rod-like glue would be collapsed when rotating the spiral member and cannot be extracted and retracted. Accordingly, the spiral outer diameter is set to be equal to or larger than 30% and equal to or smaller than 80% of the outer diameter of the rod-like glue. Further, when the spiral pitch of the spiral member would be set to be less than 50% of the spiral outer diameter, a volume portion of the rod-like glue which bites in the intermediaries of the spiral pitches becomes too small, thereby the screw connection between the spiral member and the rod-like glue would not be sufficient, resulting in that the glue cannot be moved up and down smoothly in the cylindrical dispenser main body. Further, when the spiral pitch would be larger than 300%, the rod-like glue would be collapsed, thereby the glue cannot be extracted and retracted. Accordingly, by setting the spiral pitch to be equal to or larger than 50% and equal to or smaller than 300% of the spiral outer diameter, the glue bites in the intermediaries of the spiral member with certainty without deteriorating the strength of the rod-like glue by which the rod-like glue and the spiral member are screwed together with certainty. Therefore, even when the rod-like glue repeatedly is extracted and retracted from and to the front end opening portion of the dispenser main body in a cylindrical shape by rotating the rotary operator element, breakage of the glue or malfunction of the extraction and retraction operation is not caused. Further, when more or less glue remains, by installing risable and foldable-down elastic retaining pieces at a top face of the slider, the glue can be extracted and retracted with certainty.

Furthermore, the slider is bonded with the bottom portion of the rod-like glue by means of the elastic retaining pieces and is not screwed with the spiral member of the rotary operator element. Further, the slider is loosely fitted to a guide wall projecting in the extracting and retracting direction at an inner wall at the inside of the cylindrical dispenser main body. In filling and solidifying the glue melted in the cylindrical dispenser main body, the slider prevents the glue from leaking to the outside and prevents the glue from detaching from the spiral member of the rotary operator element when the length of the rod-like glue is decreased during use. Accordingly, it is not necessary to form the top face of the slider in a recessed shape for holding the rod-like glue as in the conventional case. Further, the elastic retaining pieces used in bonding with the rod-like glue are foldable-down and accordingly, the elastic retaining pieces easily fold when strongly pushing the rod-like glue to a coating face thereby the rod-like glue can be used up to its final or lowermost portion.

DETAILED DESCRIPTION OF THE PREFERRED EMBODIMENT

Figure 3:
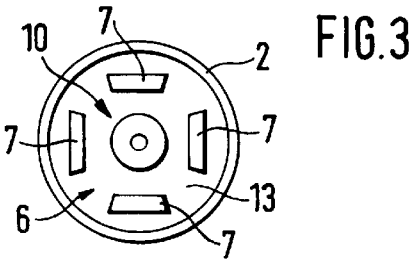
FIG. 3 is a view from above the slider of the dispenser main body.
Figure 4:
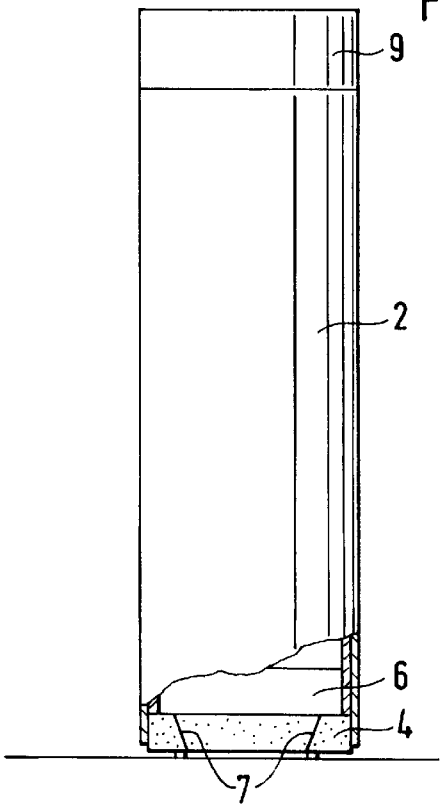
FIG. 4 is a partially sectioned view showing the operation of the elastic retaining pieces in using the glue dispenser according to the embodiment of the invention.
Figure 2:
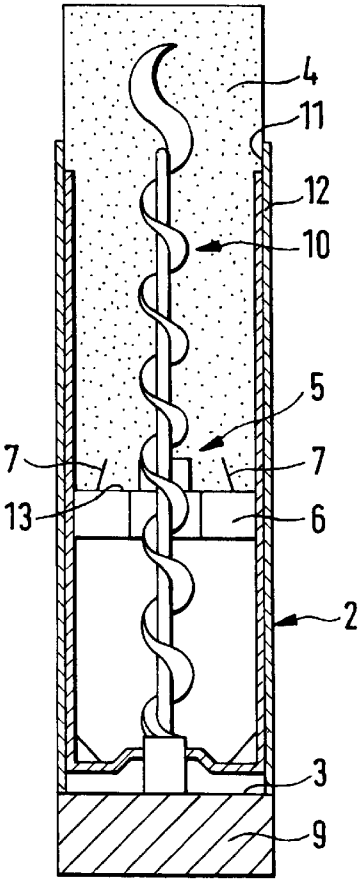
FIG. 2 is a longitudinal sectional view showing the essential parts of a dispenser main body of the glue dispenser according to the embodiment of the invention.
Figure 1:
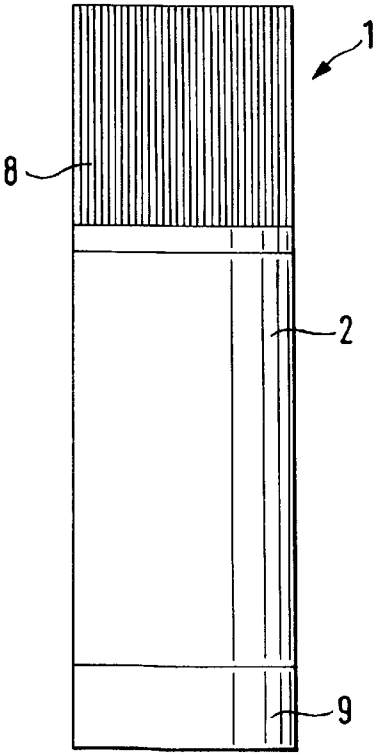
FIG. 1 is a front view of a glue dispenser according to an embodiment of the invention.

A further explanation of the invention will be given with reference to the drawings. Numeral 1 designates a glue dispenser according to an embodiment of the invention. The glue dispenser 1 according to the embodiment of the invention comprises a cylindrical dispenser main body 2 for extractably and retractably accomodating a rod-like glue 4 bonded at a bottom portion 5 thereof to a slider 6 by means of a number of foldable-down elastic retaining pieces 7 integrally formed to the slider 6 and protruding therefrom. To a front end opening portion of the dispenser is mounted a lid 8 for maintaining airtightness. A rotary operator element 9 for a spiral member 10 is rotatably attached to a bottom portion 3 of the dispenser main body 2 for extracting and retracting the rod-like glue 4. The spiral member 10 projects into the dispenser main body 2.

Further, the outer diameter of the spiral member 10 is set to be equal to or larger than 30% and equal to or smaller than 80% of the outer diameter of the rod-like glue 4 while the spiral pitch of the spiral member 10 is set to be equal to or larger than 50% and equal to or smaller than 300% of the spiral outer diameter. Further in the cylindrical dispenser main body 2, the spiral member 10 of the rotary operator element 9 is screwed directly to the rod-like glue 4 and extends through the slider 6 and the glue is integrally bonded at the bottom portion 5 thereof to the slider without the necessity of forming the slider 6 in a recessed shape having a peripheral edge projecting therefrom.

In the glue dispenser 1 according to the embodiment of the invention having with the above-described structure, by rotating the rotary operator element 9 which is rotatably attached to the bottom portion 3 of the cylindrical dispenser main body 2, the rod-like glue 4 directly screwed with the spiral member 10 integral with the rotary operator element 9, is moved up and down along with the slider 6 bonded to the bottom portion 5 of the glue by the foldable-down elastic retaining pieces 7 as necessary and can be extracted and retracted from and to the front end opening portion of the cylindrical dispenser main body 2.

The spiral member 10 of the rotary operator element 9 directly screwed to the rod-like glue 4 bonded with the slider 6 by the foldable-down elastic retaining pieces 7 integrally formed with the slider 6 at a bottom portion 5, has a spiral outer diameter which is set to be equal to 30% or larger and equal to 80% or smaller of the outer diameter of the rod-like glue 4 and a spiral pitch which is set to be equal to or larger than 50% and equal to or smaller than 300% of the spiral outer diameter thereby portions of the rod-like glue 4 bite into intermediaries of the spiral member 10 with certainty without deteriorating the strength of the rod-like glue 4, the rod-like glue 4 and the spiral member 10 of the rotary operator element 9 are screwed together with certainty and accordingly, the rod-like glue 4 can be moved up and down at inside of the cylindrical dispenser main body 2 by rotating the rotary operator element 9. Even when the rod-like glue 4 is repeatedly extracted and retracted from and to the front end opening portion of the cylindrical dispenser main body by rotating the rotary operator element 9, breakage of the glue and malfunction of extraction and retraction are not caused.

Further, at the bottom portion 5 of the rod-like glue 4, the slider 6 is only bonded with the rod-like glue 4 by the foldable-down elastic retaining pieces 7 and is not screwed with the spiral member 10 of the rotary operator element 9. Further, the slider is only loosely fitted to a guide wall 12 projected in the extracting and retracting direction of the rod-like glue 4 at an inner wall 11 of the cylindrical dispenser main body 2. The slider 6 prevents the molten glue from leaking to the outside in filling and solidifying the molten glue at the inside of the cylindrical dispenser main body 2. The slider is for preventing the glue from detaching from the spiral member 10 of the rotary operator element 9 by stresses caused in using it when the rod-like glue 4 is decreased by using it. Therefore, a top face 13 of the slider 6 needs not to be formed in a recessed shape for holding the rod-like glue 4 as in the conventional case. Further, the elastic retaining pieces 7 used for bonding the rod-like glue 4 are foldable-down. Therefore, by strongly pressing the rod-like glue 4 to a coating face, the elastic retaining pieces 7 easily can fold down and accordingly, the rod-like glue 4 can be used up to its final portion.

The invention is constituted as described above and accordingly, the rod-like glue contained in the cylindrical dispenser main body can be extracted and retracted from and to the front end opening portion of the dispenser main body as necessary by a simple structure of the dispenser and the rod-like glue can be used up to its final portion and accordingly, there is provided an excellent effect capable of achieving resources conservation and at the same time, a reduction in assembly cost.

What is claimed is:

1. A dispenser for rod-like glue including:

a cylindrical dispenser main body accommodating a rod-like glue a bottom portion thereof being bonded to a slider; and a rotary operator element having a spiral member projecting into the dispenser main body and rotatably attached to a bottom portion of the dispenser main body for extracting and retracting the rod-like glue from and into a front end opening portion of the dispenser main body, said spiral member extending through said slider without a screwed engagement therewith;

said spiral member having a spiral outer diameter which is set to be equal to or larger than 30% and equal to or smaller than 80% of an outer diameter of the rod-like glue, and a spiral pitch which is set to be equal to or larger than 50% and equal to or smaller than 300% of the spiral outer diameter, said spiral member of the rotary operator element is screwed directly to the rod-like glue in the cylindrical dispenser main body.

2. The dispenser for rod-like glue according to claim 1 in which a lid is mounted to the front end portion of the dispenser main body for maintaining airtightness of the interior thereof.

3. The dispenser for rod-like glue according to claim 1 in which said slider having foldable-down elastic retaining pieces integrally with and protruding from the slider for bonding the bottom portion of the rod-like glue with the slider.

* * * * *